United States Patent [19]

Pracher et al.

[11] 4,112,399

[45] Sep. 5, 1978

[54] MINIATURE RELAY

[75] Inventors: Ernst Pracher, Oberhaching; Wolfgang Adalbert Schrötter, Unterhaching; Wolfgang Heider, Lenggries, all of Germany

[73] Assignee: Bunker Ramo Corporation, Oak Brook, Ill.

[21] Appl. No.: 723,101

[22] Filed: Sep. 13, 1976

[30] Foreign Application Priority Data

Oct. 8, 1975 [DE] Fed. Rep. of Germany ..... 2545180

[51] Int. Cl.[2] ..... H01H 67/00

[52] U.S. Cl. ..... 335/106; 335/202

[58] Field of Search ..... 335/106, 107, 128, 129, 335/202

[56] References Cited

U.S. PATENT DOCUMENTS

| | | | |
|---|---|---|---|
| 3,553,729 | 1/1971 | Mori et al. | 335/106 X |
| 3,889,087 | 6/1975 | Graeff | 335/106 X |
| 3,911,383 | 10/1975 | Tabei et al. | 335/106 |

*Primary Examiner*—George Harris

*Attorney, Agent, or Firm*—William Lohff; F. M. Arbuckle

[57] ABSTRACT

A miniature relay with four connector pins arranged in a row and which, along with a solenoid coil, an armature, and contacts, are supported in a housing consisting of two portions. The housing is of such a size that the base area is approximately one-eighth that of a 16-contact "DIL" socket, and the four connector pins are spaced to mate with four of the "DIL" contacts, thereby to allow a plurality of relays to be accommodated in a single "DIL" socket.

12 Claims, 11 Drawing Figures

MINIATURE RELAY

BACKGROUND OF THE INVENTION

1. Field of the Invention

The invention pertains to the field of miniature electro magnetic relays, particularly to relays so adapted as to mate with "DIL" connectors.

2. Description of the Prior Art

U.S. Pat. No. 3,889,216 has disclosed a miniature relay with dimensions corresponding to the base area of a 16-pole "DIL" pin socket. The relay is produced by slotting from a single metal strip both the contacts and the terminals for four switchover contacts; the metal components are obtained by bending the plane of the metal strip. The connections for the four switchover contacts are provided in the form of eight pin contacts, each provided on opposite lateral edges of the metal strip. The metal strip, prepared in this fashion and provided with four contacts, is then applied to the lower part of a two-component housing; two metal coils having two armatures are applied to the center section of the lower housing portion so that two switchover contacts appear on opposite sides of the solenoid coil. Then, according to the above-noted patent, the upper housing portion is applied for the purpose of clamping the individual connector strips and contact strips; then the upper housing portion is joined with the lower housing portion. The connector pins, which up to that time were joined via bridges, are separated; after that, the connector pins, which protrude on opposite sides of the housing and so far have remained in a common plane, are bent backward in the same direction by 90° so that they can be plugged into the jacks of a 16-contact "DIL" socket. The disadvantage of the known relay configuration is that each module has four switchover contacts, which implies considerable additional expenditure in the case that only one switchover contact is used in such a module. It is another disadvantage that the connector pins must be bent after the actual assembly, so that the proper adjustment of the relay may be disturbed.

It was proposed in the above-specified patent to insert, if necessary, only the solenoid along with the switchover contacts and four connector pins into the housing, provided that only the function of a switchover relay is wanted. However, in addition to the disadvantages resulting from the manufacturing process, an additional disadvantage results from the fact that this relay with a single swichover contact requires the space of a 16-pole "DIL" socket.

German Pat. No. 2,245,803 to Sauer has disclosed a rotary armature relay in which a solenoid coil with a brace-like armature is supported by a base plate from which in the "DIL" configuration there protrude 16 pins downward from the base plate so that the relay can be plugged into a 16-contact "DIL" socket. The armature carries actuating members which are disposed on opposite sides and can be engaged by a switchover contact arm which is resiliently mounted on the base plate and cooperates with two fixed contacts. The solenoid contact system can be closed with the aid of a housing cap which can be applied to the base plate and ensures a hermetic seal with it. The disadvantage of this relay is that necessarily two swichover contacts must be provided in a single housing even when only a single contact is required. Futhermore, the known relay requires a relatively large area on the base of a 16-contact "DIL" socket.

SUMMARY OF THE INVENTION

It is therefore an object of the invention to provide a more versatile miniature relay which allows greater economy, both in cost of manufacture and in space required, per switching function.

It is a further object of the present invention to disclose a miniature relay which provides a greater flexibility in use in "DIL" connector systems.

An additional object of the invention is to provide a "DIL" relay which allows for a greater number of switching functions in a given space than allowed by the prior art.

According to the invention, the above objects are realized in a miniature relay of the above-specified type by providing a housing base area equal to about ⅛ of the base area of a 16-contact "DIL" socket, said housing base area penetrated by connector pins; by arranging a solenoid coil on the plane of the connector pins; and by providing recesses which are adapted to the respective components and readjust the same upon insertion, said recesses disposed inside the housing which is accessible through a side wall covered with a lid, wherein said components can be fixed in their positions with the aid of contours provided in said lid.

A "DIL" socket is defined as a socket with two oppositely disposed rows of parallel contact members.

The above configuration makes it possible to combine four relays into a single 16-contact "DIL" socket. On the other hand, when the miniature relay of the invention is used on non-standard connectors with an area corresponding to a 16-contact "DIL" socket, it is possible to accommodate eight miniature relays of the subject invention on the corresponding area. This means that the number of possible switching functions can be considerably increased while the space requirements are the same as for a prior-art "DIL" relay. The miniature relay of the subject invention is easy to assemble because before they are inserted, the components of the contact and pin system can be bent to their respective positions. Thereafter these components need be inserted only into the pre-formed recesses in the housing. In these recesses, the components are preadjusted so that usually no additional adjustments must be made in the assembly operations.

By providing appropriate contours on the lid covering the housing, the components of the contact and pin system, as well as the solenoid coil, can be fixed without need for additional attachment means. The lid can be sealed to the housing with the aid of known techniques such as gluing, ultrasonic welding, etc., so that a contact space hermetically sealed from the environment is created. Therefore, as far as cost of material per switching function, space requirements, and cost of production are concerned, the relay of the subject invention is a low-cost item, has low weight, and can be used in a large number of applications.

The base area of the miniature relay of the invention is chosen so that one side of the housing base area is at most equal to the spacing of a "DIL" socket and is preferably 2.5 or 2.54 mm (0.1 inch) long. In this way the other side of the housing base area is conveniently made equal to four times the length of the first side.

In order to shield the miniature relay from the outside, a metal casing may be put over the relay.

The relay is conveniently designed as either a closing relay or an opening relay so that, according to the specific requirements, a closing relay and an opening relay can be combined to form a changeover or a sequential changeover relay.

The components of the contact and pin system can be made from a single multi-metal strip which, before the contact and pin system is inserted into the housing, is bent to its final shape so that the adjustment which once was obtained is not lost thereafter by bending operations that might be necessary.

The contact and pin system is preferably formed so that it can be produced for either a closing relay or an opening relay by slotting or etching operations performed on a pretreated multi-metal strip which can be subjected to mirror-inverted bending operations. This considerably reduces the cost of production of the contact and pin system and simplifies the required manufacturing operations.

If several miniature relays are combined to form a single block, the additional advantageous feature is that the outside of the housing wall facing the lid can be provided with contours matching the lid. In this manner it is not necessary to use a lid on relay housings following the first relay of a set of relays to be combined to form a block, because the lid is formed by the wall of preceding relay housing. This implies savings in both material and assembly time.

BRIEF DESCRIPTION OF THE DRAWINGS

The following detailed description of the invention is to be considered with reference to the preferred embodiment shown in the drawings. In the drawings.

DESCRIPTION OF THE PREFERRED EMBODIMENTS

Figure 1:
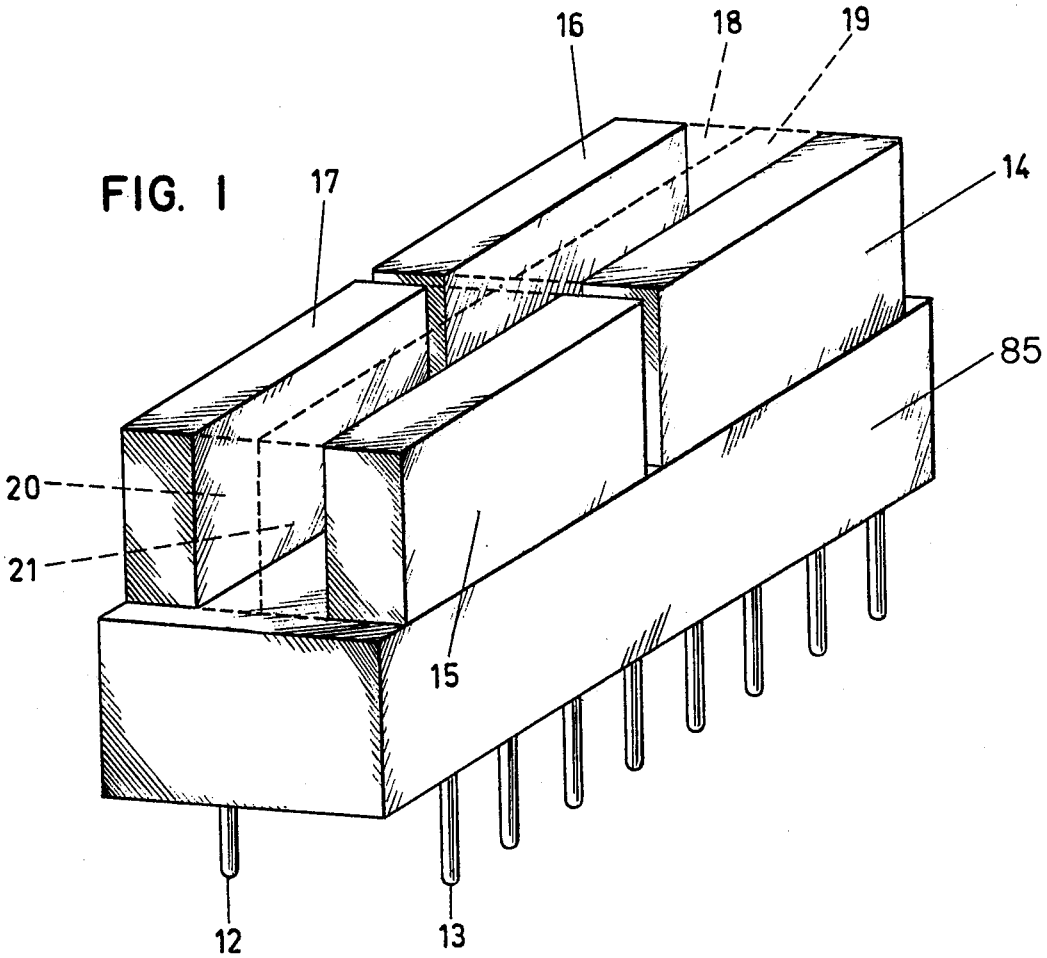
FIG. 1 is a perspective view of a standard 16-contact "DIL" socket into which four miniature relays of the invention have been inserted.
Figure 2:
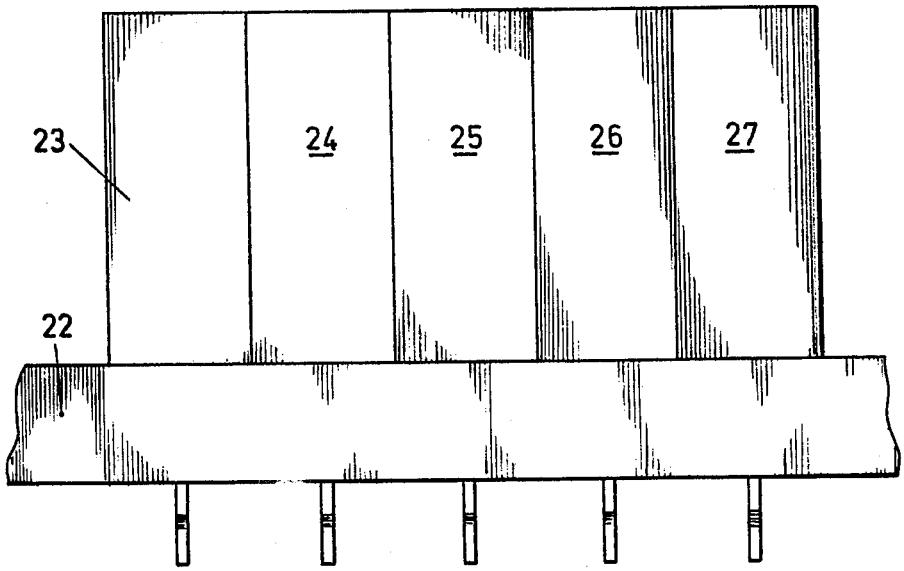
FIG. 2 is a side view of some type of socket in which several miniature relays of the subject invention have been inserted in side-by-side relationship.

FIG. 1 shows a 16-contact "DIL" pin socket 85 provided with two rows of contacts 12 and 13 having 8 connector pins each. Four miniature relays 14–17 according to the invention and shown by full lines have been inserted into the jacks (not shown) provided on the surface of "DIL" socket 85. As shown in FIG. 1, each of miniature relays 14–17 requires only a small base area so that 8 miniature relays having the size of miniature relays 14–17 can be accommodated on the base area of a 16-contact "DIL" socket. The four miniature relays 18–21 are indicated by dashed lines to illustrate this feature. In this manner, miniature relays of the subject invention can be used both in conjunction with the standard DIL connector system and, as shown in FIG. 2, on a printed circuit 22.

In this case several miniature relays 23–27 can be arranged in extremely closely packed side-by-side relationship. This affords a large number of applications with extremely small space requirements.

Figure 3:
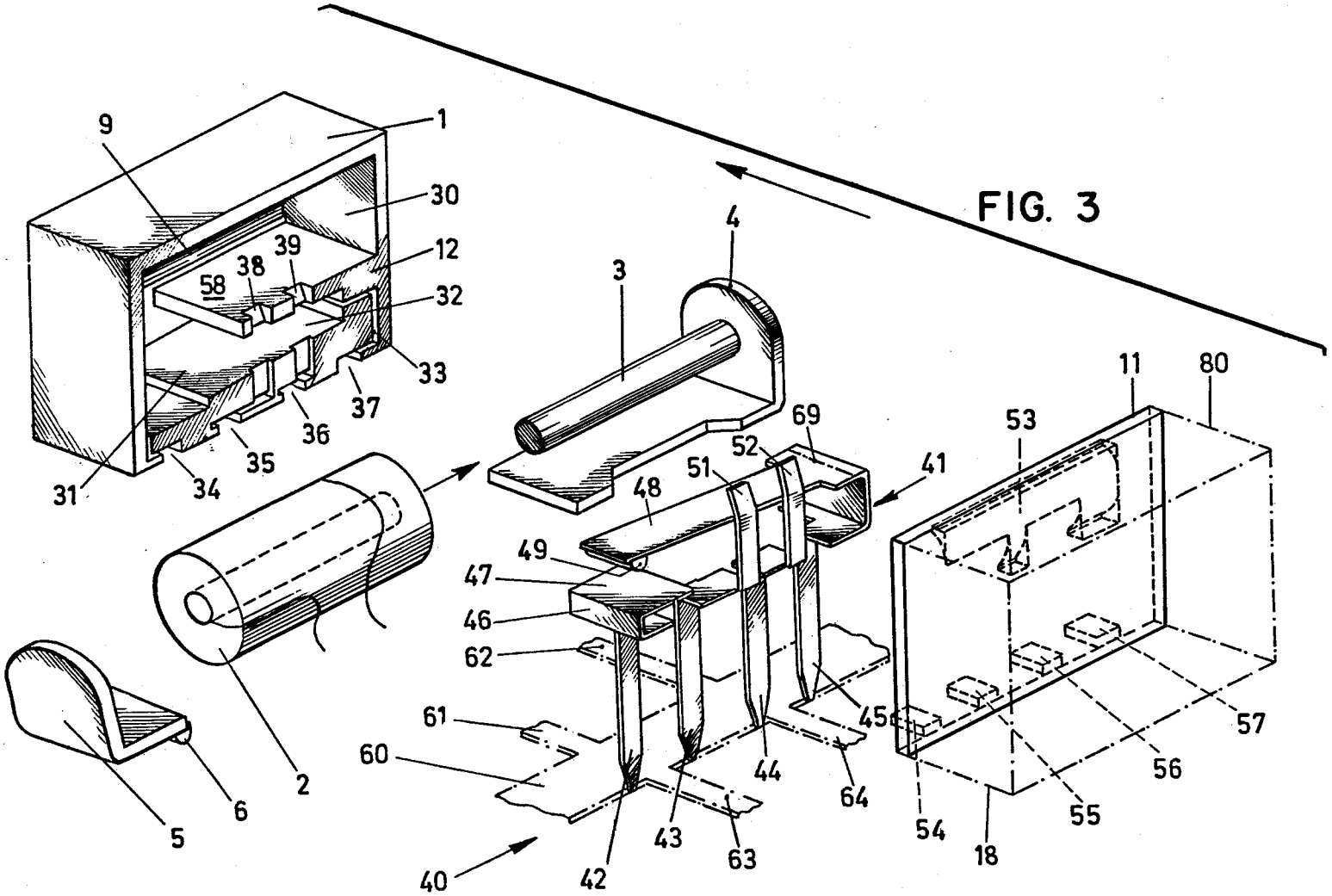
FIG. 3 is an exploded view of an embodiment of a miniature relay according to the invention.

FIG. 3 is an exploded view of a miniature relay according to the invention. Housing 1 is open on one side and can be closed with the aid of a lid 11. Housing 1 is provided with recesses and indentations 30–39 shaped to receive and position the components of the contact and pin system described below. The relay comprises a yoke 4 with a core 3 onto which a self-supporting winding 2 having the form of an annular cylinder can be pushed. The resulting electromagnet cooperates with an 5 having the form of a brace which has an insulator 6 on the end of its leg and on the side facing the contact arm of the contact system described below. Insulator 6 has the form of a pearl or a rib.

The dashed lines of FIG. 3 show a multi-metal strip 40 from which the components of the contact and pin system 41 are obtained by slotting or etching and subsequent bending to the desired shape. Before the miniature relay is completed, the components of the contact system remain joined with multi-metal strip 40 via connector pins 42–45. Multi-metal strip 40 forms a support common to all components. A fixed contact 40 is integral with connector pin 42. Fixed contact 46 has U shape and movable contact 48 can be engaged by the one arm 47 of contact 40. Movable contact 48 is a long tonguelike member to whose free end contact rib 49 is attached. Contact rib 49 can engage arm 47. The movable contact is integral with connector pin 45. Pins 43 and 44 form soldering lugs 51 and 52 for coil 2. As shown most clearly in FIG. 3, connector pins 42–45 are aligned in a row.

On the side facing housing 1, lid 11 is provided with contours 53–57 having the form of protrusions or ribs with which the components of the electromagnet and of the contact and pin system can be positioned inside housing 1.

The miniature relay shown in FIG. 3 is assembled as follows. Coil 2 is pushed onto core 3 and armature 5 is applied to the coil so that the armature leg carrying insulator 6 appears underneath yoke 4. Then this unit is inserted into the housing so that the yoke carrying the coil is situated inside recess 30, whereas the armature enters into recess 31. After that, the entire contact and pin system 41, which still adheres to multi-metal strip 40, is inserted. When this is done, pin 42 and fixed contact 46 enter into recess 34. Connector pins 43 and 44 are pushed into recesses 35 and 36 until soldering lugs 51 and 52 abut recesses 38 and 39, at the same time the movable contact arm of connector pin 45 is inserted into recesses 37, 33, and 32 so that the movable contact arm is situated within the free space in recess 32. Thereafter the free ends of coil 2 are soldered to soldering lugs 51 and 52; then the entire housing 1 is closed by applying lid 11. When this is done, contours 53–57 provided on lid 11 clamp the components and keep them in their positions. Finally, the lid is glued or welded to the housing or joined with it in some other fashion. Then the connector pins 42–45 are separated from multi-metal strip 40. This terminates the assembly of the relay of the invention.

Figure 4:
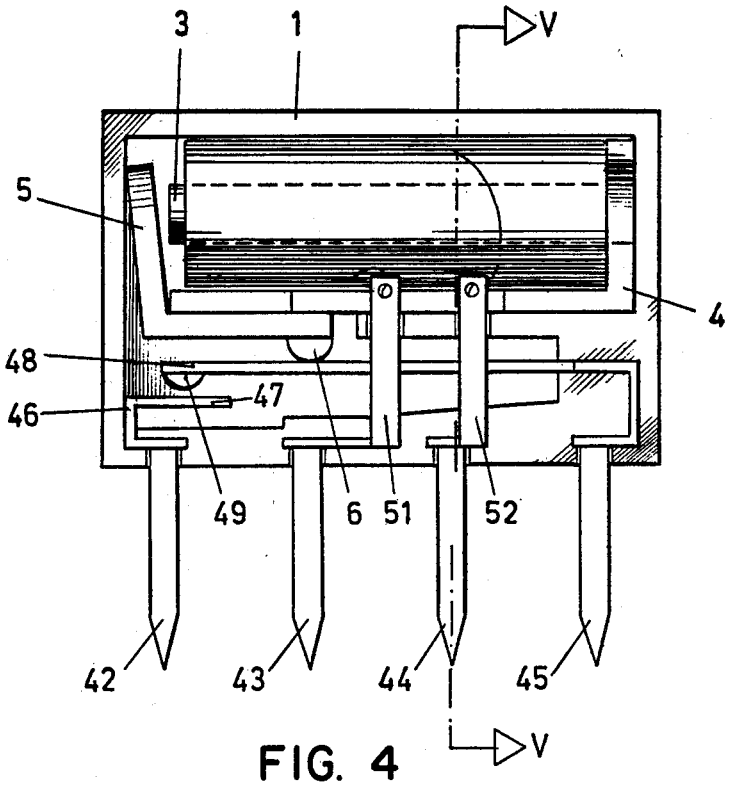
FIG. 4 shows another embodiment of a miniature relay according to the invention; the relay is adapted to function as a closing relay, wherein the housing is shown with the components inserted before application of the lid.

FIG. 4 shows another miniature relay with a housing 1 open on one side. The components of the electromagnet and the contact and pin system have been inserted into the housing. The relay shown is a closing relay, i.e., unless the coil is energized, movable arm 48 does not engage fixed contact 46. The resilience of movable arm 48 keeps armature 5 and the leg carrying insulator 6 pressed against the bottom of yoke 4. When the electromagnet is energized, the brace-shaped armature is rotated clockwise around the apex which functions as a pivot (see FIG. 4) so that the armature acts via insulator 6 against the movable contact arm 48 which is pushed downward against fixed contact 46. This closes the electrical circuit.

Figure 5:
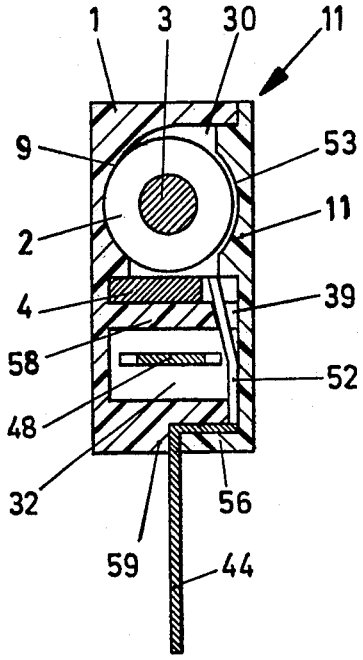
FIG. 5 is a cross section of the embodiment shown in FIG. 4, wherein, in distinction to FIG. 4, the lid is shown applied to the housing.

FIG. 5 shows details of the contours formed on the inside of housing 1 and the inside of lid 11. Recess 30 on the inside of housing 1 has a practically semi-cylindrical contour 9 against which cylindrical coil 2 bears. Lid 11 has an accordingly concave contour so that the solenoid coil is firmly kept in its position once the lid has been applied. The bottom of yoke 4 bears against a bridging section 58 which is integral with the housing. Between bridging section 58 and bottom section 59 of the housing, through which the connector pins penetrate, there is a recess 32 with substantially rectangular cross section. Movable contact arm 48 protrudes through this recess. Soldering lug 52 bears against recesses 39 in the bridging section 58 and is kept in this position by lid 11. Connector pin 44 is pressed by contour 56 in lid 11 onto wall 59 in the bottom portion of the housing and firmly kept in this position.

Figure 6:
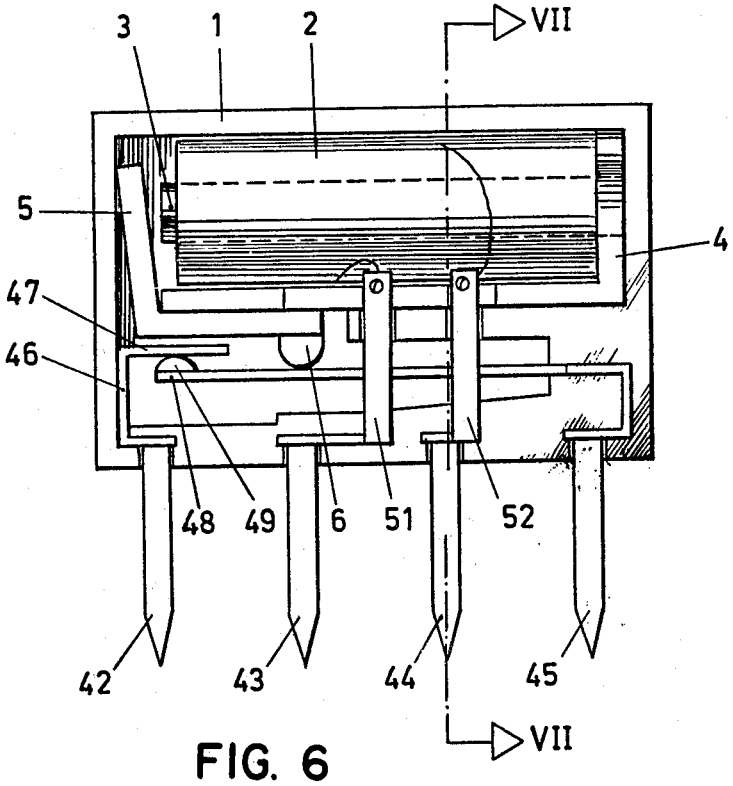
FIGS. 6 and 7 resemble FIGS. 4 and 5 but refer to another embodiment of a miniature relay of the invention, with the relay functioning as an opening relay.
Figure 7:
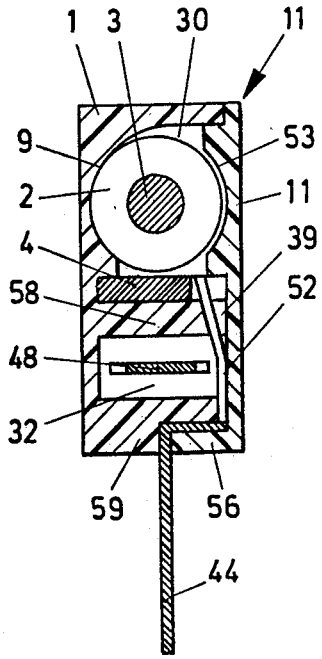

FIGS. 6 and 7 show an embodiment of the relay which is an opening relay according to the invention. The design of this relay coincides with the design of the relay shown in FIGS. 4 and 5; therefore the same reference numbers are employed. The opening relay shown in FIGS. 6 and 7 is distinguished from the closing relay insofar as the multi-metal strip, from which the contact and pin system is bent, is mirror-inverted, as explained below. Therefore in this case contact rib 49 of movable contact arm 48 is located on the side facing solenoid coil 2 and normally bears against the bottom of arm 47 of fixed contact 46. By energizing the electromagnet and rotating the armature in the manner outlined above, movable contact arm 48 is pressed downward via insulator 6 (FIG. 6) so that contact rib 49 disengages arm 47 of fixed contact 46. Since the design of the relay agrees in all other aspects with the design of the relay shown in FIGS. 4 and 5, the design need not be described once more.

Figure 8:
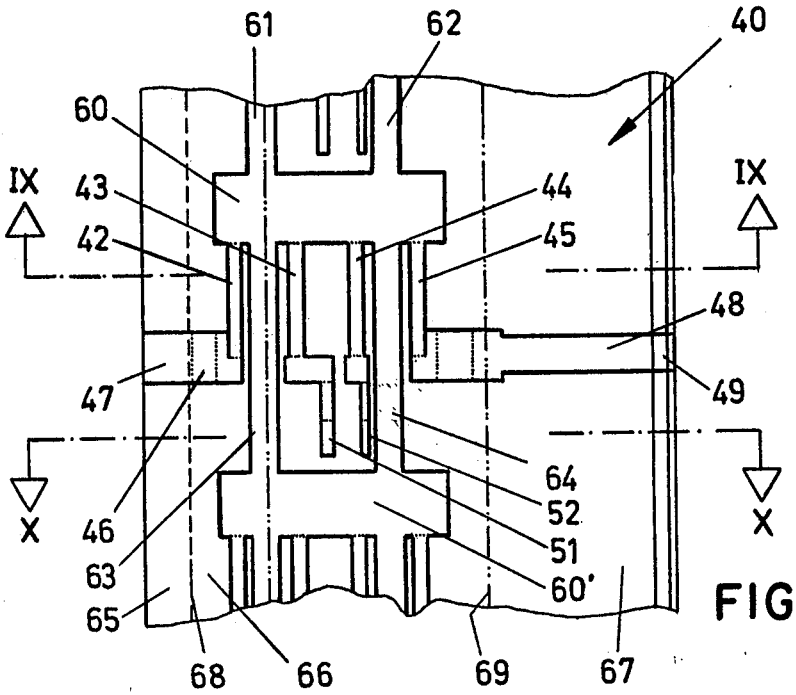
FIG. 8 is a top view of a multi-metal strip used to produce the contact and pin system, with components which are subsequently slotted or etched and then bent to form the respective parts of the contact and pin system; the outlines of the components are traced on the metal strip.

FIG. 8 is an enlarged-scale view of multi-metal strip 40 from which the contact and pin connector and contact system is formed. The pattern on multi-metal strip 40 is indicated with thick solid lines; this pattern is slotted or etched from the strip. It follows from FIG. 8 and from inspection of FIG. 3 that several coherent contact and pin systems are cut in succession from strip 40. Two basic web sections 60 and 60' of two neighboring systems are shown. The basic web sections are joined by bridging sections 63 and 64 whereas bridging sections 61 and 62 establish a junction to the neighboring (not shown) basic web sections. Portions of connector pins 42–45 are integral with basic web sections 60 and extend substantially parallel with bridging sections 63 and 64.

The sections of fixed contact 46 and of movable contact 48 are joined in L-shaped form with the respective connector pins and soldering lugs 43 and 44. The dashed lines indicated at the contacts denote the lines of bending, i.e., the lines along which the individual parts are bent to the shape shown in FIG. 3.

Multi-metal strip 40 is subdivided into three substantially parallel sections 65, 66, 67. Section 66 consists of a material for contacts which is capable of sustaining high switching loads such as Ag. For economic reasons section 66 can be subdivided into two subsections; connector pins 42–45 are made from a material less noble than Ag (e.g., brass or nickel silver, etc.). Section 65 is plated with a noble metal such as Au, as shown most clearly in FIGS. 9 and 10. The noble metal plating is used preferably when low loads are to be switched. Strip 67 consists of a metal used for springs, because movable contact arm 48 is made from this strip. The position of partition line 69 between sections 66 and 67 is indicated in FIGS. 3 and 8. Along the right edge (FIG. 8) there extends a rib of a welded contact, preferably made of Ag or Ag combined with Au; this rib extends to contact rib 49 shown in FIG. 3, once the contact system has been finished. The various areas are obtained from multi-metal strip 40 by slotting or etching; thereafter the bending operations are performed along the indicated dashed lines to obtain the contact and pin system 41 shown in FIG. 3.

Figure 9:
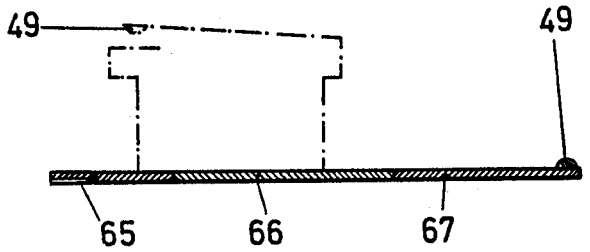
FIG. 9 is a cross section along line IX—IX of FIG. 8, wherein the dashed lines refer to a closing relay contact set which can be bent from the metal strip.
Figure 10:
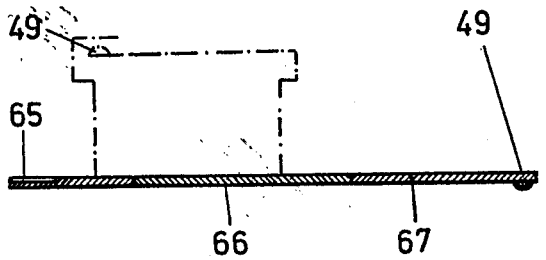
FIG. 10 is a cross section along line X—X of FIG. 8, wherein the dashed lines refer to an opening relay contact set which can be bent from the metal strip.

FIGS. 9 and 10 illustrate how a closing relay or opening relay can be obtained from the same contact strip 40 by mirror-inverted bending of the individual sections toward opposite sides of the strip 40. The components outlined by dashed-and-dotted lines in FIGS. 9 and 10 are not drawn to scale relative to the cut through multi-metal strip 40 shown; the markings are intended to show schematically the way of bending the multi-metal strip.

Figure 11:
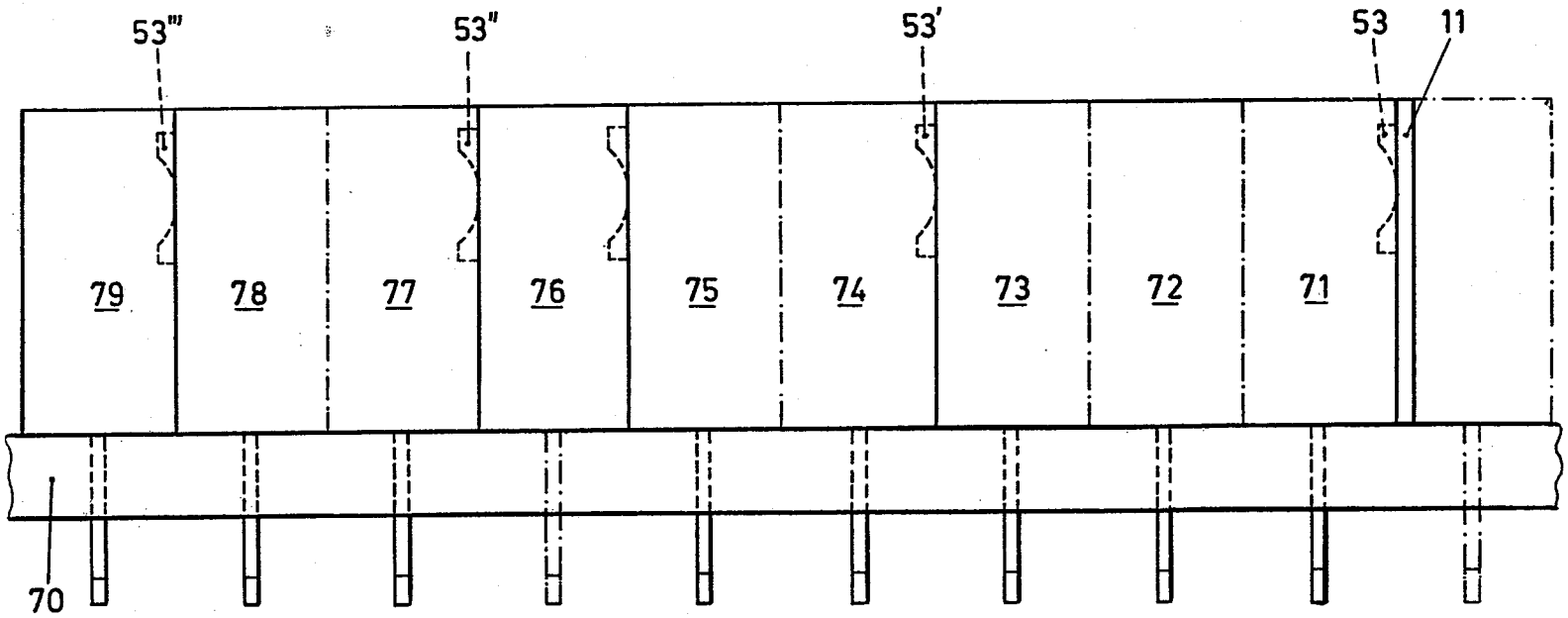
FIG. 11 resembles the view of FIG. 2, wherein several miniature relays have been combined to form a relay block.

FIG. 11 shows schematically several housings 71 through 79 which are joined to a common block and mounted on a common printed circuit board 70. Rightmost housing 71 of FIG. 11 is closed with a lid 11 having contours 53. Not all the housings of the row of housings enclose a relay according to the invention; such relays are enclosed only in housings 71, 74, 76, 77, and 79. Housings 72, 73, 75 and 78 in intermediate positions can be housings of some other form in which additional circuit components such as resistors, diodes, capacitors, etc. can be mounted. The advantage of this configuration is that, as indicated above, the lid required for closing the housing which follows the first housing is redundant. FIG. 3 shows lid 11 in solid lines. The figure illustrates, in addition to lid 11, a housing 80 outlined by dashed-and-dotted lines. Housing 80 can be considered a housing adjacent to housing 1 when a block is to be formed.

In this case, the portion shown in FIG. 3 as lid 11 forms the side wall of housing 80 which is provided with additional contours 53–57 on the outside of the sidewall. This possibility was assumed in FIG. 11 for housings 73, 75, 76, and 78 which have the additional contours 53', 53'', and 53''' on the left outer wall (FIG. 11) of the respective housing. Thus, when the housings are assembled to form a module, the lid of two neighboring housings becomes redundant; the lid is required only for the first housing 71.

From the foregoing it can be readily realized that this invention can assume various embodiments. Thus it is to be understood that the invention is not limited to the specific embodiments described herein, but is to be limited only by the appended claims.

What we claim is:

1. A miniature relay comprising:

a housing including a base and a lid, said base having a plurality of recesses therein for receiving and supporting electro-mechanical elements for said relay in predetermined positions, said lid closing a side of said housing base and having contours on its inner surface to aid in positioning the electro-mechanical elements in said predetermined positions;

a plurality of connector pins penetrating the bottom of said housing, said connector pins arranged in a row and lying in a common plane;

at least two contacts supported in said housing and connected to respective ones of said connector pins;

a solenoid coil supported in said housing, the axis of said solenoid coil located in said common plane, said coil having a pair of lead wires connected to respective ones of said connector pins, said lid and said base both including shaped portions embracing said solenoid coil; and an armature movable by energization of said solenoid coil and engageable with at least one of said contacts to effect selective opening and closing of said contacts.

2. The relay as claimed in claim 1, wherein the area of the bottom of said housing is equal to approximately one-eighth that of a 16-contact double-in-line socket.

3. The relay as claimed in claim 2, wherein:

said plurality of connector pins is 4; and said plurality of connector pins have pin spacings corresponding to the sockets of a 16-contact double-in-line socket;

whereby four offset miniature relays can be plugged into a single double-in-line socket.

4. The relay as claimed in claim 1, wherein one side of said housing bottom is at most equal to the spacing of a double-in-line socket and is approximately 0.1 inch long.

5. The relay as claimed in claim 2, wherein the other side of said housing bottom is approximately four times the length of said first side.

6. The relay as claimed in claim 1, including a metal casing about said housing and lid combination.

7. The relay as claimed in claim 1, wherein said relay is a closing relay, and said contacts are normally open.

8. The relay as claimed in claim 1, wherein said relay is an opening relay, and said contacts are normally closed.

9. The relay as claimed in claim 1, wherein said connector pins and said contacts are made from multi-metal strip and bent before being inserted into said housing.

10. The relay as claimed in claim 9, wherein said connector pins and said contacts are stamped from a single multi-metal strip by mirror-inverted bending of the strip which was pretreated by slotting or etching.

11. The relay as claimed in claim 9, wherein, in order to obtain optimal spring-like resilient properties, the thickness of said multi-metal strip varies in the area of one of said contacts.

12. The relay as claimed in claim 1, characterized in that the side of the base housing wall facing said lid is provided with contours corresponding to said lid.

* * * * *